United States Patent [19]

Chao

[11] Patent Number: 5,030,246

[45] Date of Patent: Jul. 9, 1991

[54] CONTINUOUS PROCESSES FOR ACID DYEING OF STAIN RESISTANT NYLON CARPETS

[75] Inventor: Nelson P. C. Chao, Pensacola, Fla.

[73] Assignee: Monsanto Company, St. Louis, Mo.

[21] Appl. No.: 217,023

[22] Filed: Jul. 11, 1988

[51] Int. Cl.[5] ..... C09B 67/00

[52] U.S. Cl. ..... 8/618; 8/620; 8/680; 8/924; 8/929; 428/97; 428/375; 428/378; 428/392

[58] Field of Search ..... 8/620, 618

[56] References Cited

U.S. PATENT DOCUMENTS 4,680,212 7/1987 Blyth et al. ..... 428/97

OTHER PUBLICATIONS

E. R. Trotman, "Dyeing and Chemical Technology of Textile Fibres", Sixth Edition, (Wiley-Interscience), 1984, pp. 336–346 and 475–477.

*Primary Examiner*—A. Lionel Clingman

*Attorney, Agent, or Firm*—John W. Whisler

[57] ABSTRACT

Carpets comprising nylon fibers which have been coated with stainblocker and subjected to dry heatsetting conditions (e.g. 200° C.) are continuously dyed with acid dye liquor to deep shades of color by adding certain slats (e.g. ammonium sulfate) to the liquor.

10 Claims, No Drawings

CONTINUOUS PROCESSES FOR ACID DYEING OF STAIN RESISTANT NYLON CARPETS

BACKGROUND OF THE INVENTION

This invention relates to carpets having a pile comprising nylon 66 fibers which have been coated with stainblocker and subjected to dry heatsetting conditions. More specifically, the invention relates to an improvement in conventional processes for continuously dyeing such carpet with acid dyes.

The term "fibers", when used herein, includes fibers of extreme length or indefinite length (i.e. filaments) and fibers of short length (i.e. staple).

The term "yarn", when used herein, means a continuous strand of fibers (singles yarn) or a yarn formed by twisting together two or more strands of fibers (plied yarn).

The term "dry heatsetting conditions", when used herein, means the conditions of time and temperature conventionally used to set the twist in nylon plied carpet yarn using dry heat, as opposed to steam, as the heat source. Typically, when nylon plied yarn is dry heatset using Suessen equipment, the yarn is exposed to temperatures ranging from 190° C. to 205° C. for a period about one minute.

The term stainblocker, when used herein, means a chemical which when applied to nylon fibers as a coating provides fibers having the ability to resist staining with Food, Drug and Cosmetics (FD&C) Red Dye No. 40, a acid dye colorant used to impart red color to foods, beverages and medicines, for example, to cherry Kool Aid ®.

U.S. Pat. No. 4,680,212 describes nylon fibers coated with stainblocker. The stainblocker coating on the fibers somewhat reduces the rate at which yarns comprising these fibers take up acid dyes. Subjecting nylon fibers to dry heatsetting conditions also reduces the rate at which the fibers take up acid dye by rendering the fibers less porous. Consequently, carpets which have nylon pile fibers that have been both coated with stainblocker and subjected to dry heatsetting conditions cannot be dyed with acid dyes to deep shades of color using conventional processes for continuously dyeing nylon carpet. In such processes a length of carpet of a selected width is longitudinally passed through a zone in which the pile fibers are treated with an aqueous liquor comprising an acid dye and then passed through an atmosphere of steam to set the dye on the fibers. The carpet is thereafter washed with water to remove excess liquor (including dye) from the fibers and, finally, dried and collected. Under these conditions, the fibers simply do not take up sufficient dye to provided deep shades of color.

SUMMARY OF THE INVENTION

The present invention provides an improvement in conventional processes for continuously dyeing carpet comprising nylon 66 pile fibers which have been coated with stainblocker and subjected to dry heatsetting conditions, whereby the carpet can be dyed to deeper shades of color with acid dyes. The improvement comprises adding a sufficient amount of salt selected from the group consisting of ammonium salts and metal salts to the dye liquor used in such processes. By a "sufficient amount" is meant an amount that will provide carpet of a deeper shade of color than if said salt is omitted from said liquor.

PREFERRED EMBODIMENTS OF THE INVENTION

The preparation of nylon fibers coated with stainblocker and carpets made therefrom are described in detail in U.S. Pat. No. 4,680,212. Accordingly, the disclosure of U.S. Patent 4,680,212 is incorporated herein by reference.

In a typical process for continuously dyeing carpet comprising nylon 66 pile fibers, carpet of a selected width (e.g. 12 feet) is unwound from a beam and passed through a zone where the pile fibers are treated with an aqueous medium containing acid dye (i.e. dye liquor), for example, by applying the liquor to the pile fibers by means of overhead nozzles or by means of an overhead reservoir from which the liquor is applied to the carpet from openings in the reservoir. In certain processes the carpet is treated with a wetting agent prior to application of the dye liquor by passing the carpet through an aqueous solution of a wetting agent. Commercially available wetting agents include decylalchol, sodium dioctyl sulfosuccinate and ethoxylated fluoro alcohol. The amount of wetting agent used may vary over a wide range. Typically, the wetting solution contains from 0.1 to 1.5% by weight of the wetting agent. In commercial practices the dye liquor and pre-wetting water, when used, are not heated so as minimize energy costs. The dye liquor is typically maintained at a pH in the range of 4.5 to 7.5. At lower pH's the carpet tends to dye unevenly (streak) and at higher pH's the pile fibers do not take up sufficient dye. The carpet is passed from said dyeing zone through an atmosphere of steam (e.g. a commercial steamer designed for this purpose) under conditions of time and temperature sufficient to set the dye on the pile fibers. Typically, the steam is maintained at 100° C. at atmosphere pressure to minimize costs and the carpet is exposed (i.e. in contact with) the steam for a period of less than 5 minutes and routinely for 3 minutes. The carpet is then washed with water, dried and wound onto a beam or otherwise collected. In carrying out the processes the carpet is transported from the source beam to the collection beam by means of driven rollers over which the carpet passes. Typically, the carpet is transported at a linear speed of about 25 ft./min. (7.6 m/min.).

In practicing the improvement of the present invention an effective amount of the ammonium and/or metal salt is added to the dye liquor. The salt may be added directly to the dye liquor or indirectly by means of a coating thereof applied to the fibers from the water used to pre-wet the fibers or by other suitable means. The amount of salt used depends on the acid dye, shade of color desired and dyeing conditions, such as temperature, time, pH, etc. Generally, a sufficient amount of the salt is added to the dye liquor to provide from 0.2 to 8% and preferably 0.5 to 3.0% by weight based on the weight of pile fibers being treated (commonly referred to as "on weight of fiber or simply o.w.f.").

Salts which are particularly useful in practicing the invention include, but are not limited to: ammonium sulfate, ammonium chloride, calcium sulfate, calcium chloride, calcium acetate, magnesium sulfate, magnesium acetate, magnesium chloride and chromium sulfate. The effectiveness of a particular salt for a given set of conditions can easily be determined by routine experimentation.

The following examples are given to further illustrate the invention. Percentages given in the examples are percentages by weight.

EXAMPLE 1

The effect of various salts on the dye depth (K/S) of nylon 66 fibers that have been coated with stainblocker (SB) and subjected to dry heatsetting conditions is evaluated under conditions simulating the conventional process for continuously dyeing nylon 66 carpet with acid dyes using Otting equipment.

An aqueous solution of Acid Blue 277 Dye (0.36% concentration) is prepared and the pH of the solution is adjusted to 6. Nylon 66 yarn having an average of 32 amine end groups per $10^6$ grams of nylon 66 is prepared and heatset (dry heatsetting conditions) as described in Example 1 of U.S. Pat. No. 4,680,212 wherein the stainblocker is a polymeric condensation product consisting essentially of repeating units of the formula

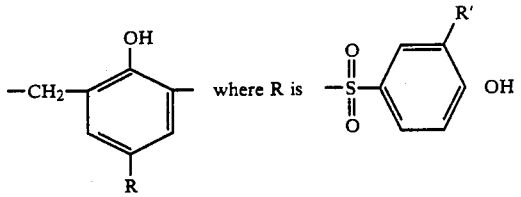

and R' is —$SO_3Na$ in at least 50% of said units and is hydrogen in the remaining units. (The fibers of the yarn are coated with 0.35% o.w.f. of SB).

In a first experiment, two grams of an aqueous solution containing 1% by volume of decyl alcohol, as wetting agent, and a one gram sample of the above yarn are added to a beaker. The yarn sample absorbs (picks up) all of the aqueous solution. The yarn sample containing wetting agent, is then added to a beaker containing 4 grams of the above dye solution. The yarn sample also absorbs (picks up) all of the dye solution. The resulting yarn sample is then placed in an autoclave containing 100° C. steam for a period of three minutes. The yarn sample is then removed from the autoclave, rinsed with cold water to remove excess dye and, finally, air dried. The dye uptake of the dried sample (Control A) is then determined by measuring reflectance (K/S) of the sample using a commercially available MacBeth MS 2000 Color Spectrophotometer with 620 nanometer wavelength filter.

Additional experiments are carried out as described in the first experiment, except in each instance 40 mg of one of salts shown in Table 1 is added to the aqueous dye solution, i.e., 1%, based on the weight of dye solution (4% o.w.f.). In yet another experiment, nylon 66 yarn having an average of 54 amine end groups per $10^6$ grams of nylon 66 is prepared and dyed as described above in the first experiment except in this instance the yarn was not coated with stainblocker (Control B). The K/S value is determined for each dyed yarn sample and is given in Table 1. The larger the K/S value, the deeper the shade of color.

TABLE 1

| | EFFECT OF SALT ON DYE UPTAKE (K/S) OF YARN | | | | | | | |
|---|---|---|---|---|---|---|---|---|
| | SULFATE | ACETATE | CHLORIDE | CARBONATE | NITRATE | PHOSPHATE | BROMIDE | FORMATE |
| Ammonium | 24.71 | 11.41 | 21.25 | 12.51 | 17.42 | 18.25 | | |
| Sodium | 13.15 | 11.56 | 13.11 | 4.81 | 10.42 | 11.01 | 9.23 | 10.88 |
| Potassium | 5.03 | | 3.66 | | | | | |
| Lithium | 19.01 | | 19.61 | 14.82 | | | | |
| Calcium | 26.61 | 30.14 | 26.13 | | | | | 14.49 |
| Magnesium | 20.61 | 23.81 | 22.45 | 11.09 | | | | |
| Barium | 4.82 | | 17.37 | | | | | |
| Chromium | 22.78 | | 7.29 | | | | | |
| Cadmium | 15.23 | | 16.59 | | | | | |
| Cerium | 14.18 | | 17.88 | | | | | |
| Control A - 4.3 | | | | | | | | |
| Control B - 20 | | | | | | | | |

The results given in Table 1 show that under the conditions used in making the experiments the addition of certain salts to the dye solution significantly increased the dye uptake of the yarn sample, for example, Control A has a K/S value of 4.3 (very light shade of blue), whereas the addition of ammonium sulfate to the dye solution increased the K/S value of the yarn to 24.7 (a deep shade of blue). Other salts that significantly increase the K/S value o the yarn are those indicated in Table 1 of being capable of providing yarn having a K/S value comparable to or greater than that of Control B.

EXAMPLE 2

In this example carpet tufted from nylon 66 yarn that has been coated with stainblocker and subjected to dry heatsetting conditions is continuously dyed using conventional Otting-equipment and procedures.

Nylon 66 yarn coated with stainblocker and prepared and heatset as described in Example 1 of U.S. Pat. No. 4,680,212 is converted to a two-ply staple yarn and tufted into carpet as described in Example 6 of U.S. Pat. No. 4,680,212. Samples of the carpet are each dyed using conventional Otting equipment and procedures in which the carpet sample is unrolled from a beam passed through a room temperature water bath containing 1% by volume of decyl alcohol, as a wetting agent, passed from the bath under nozzles which spray an aqueous solution (liquor) of a mixture of acid dyes (2.16% concentration) onto the pile fibers of the carpet sample in an amount sufficient to provide 300% of the liquor o.w.f. The mixture consists of Acid Blue 277 (29.8 wt. %), Acid Red 57 (29.8 wt. %) and Acid Orange 156 (40.4 wt. %) and produces a dye with is dark brown in color. The liquor is at room temperature. The carpet sample is then passed into a conventional steamer containing 100° C. wet steam. The carpet sample is then passed from the steam, rinsed with water, dried and collected at a rate of 7.6 m/min. The residence time of the carpet sample in the steamer is 3 minutes. Ammonium sulfate is added to the pre-wet water bath and/or dye liquor as indicated in Table 2. In each instance the K/S value of the dyed carpet sample is determined using a MacBeth MS-2000 Color Spectrophotometer with a 580 nanometer wavelength filter and is given in Table 2.

TABLE 2

| Ammonium Sulfate, % by Weight of Solution | | | |
|---|---|---|---|
| RUN | PRE-WET | DYE SOLUTION | K/S |
| 1 | none | none | 11.7 |
| 2 | 0.5 | none | 25.4 |
| 3 | 3.0 | none | 47.2 |
| 4 | none | 0.5 | 27.7 |
| 5 | 0.5 | 0.5 | 32.6 |

The results shown in Table 2 show that the addition of ammonium sulfate to the dye liquor significantly increases the dye uptake of the pile fibers. As demonstrated in Table 2, the salt may be added directly to the liquor or indirectly by adding it to the pre-wet bath.

Stainblockers which are particularly useful for coating nylon yarns include those described in U.S. Pat. No. 4,680,212, for example, polymeric condensation products consisting essentially of repeating units of the formula

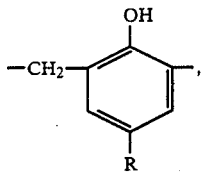

where R is the same or different from each unit and is hydrogen or a radical selected from the group consisting of

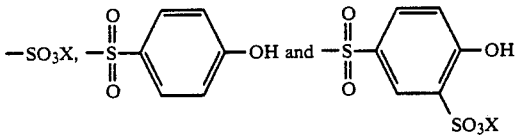

where X is hydrogen or a cation such as sodium or potassium. Preferably, the products are water soluble and at least 40% of the units contain a $-SO_3X$ radical and at least 40% contain the

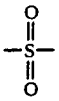

linkage. Also, useful are mixed condensation products of naphthalene monosulfonic acids with dihydroxy diphenylsulfones and formaldehyde.

What is claimed is:

1. In a process for continuously dyeing a length of carpet comprising nylon fibers which have been coated with stainblocker and subjected to dry heatsetting conditions wherein said length of carpet is passed through a zone in which said fibers are treated with an aqueous liquor comprising an acid dye and then is passed through an atmosphere of steam to set the dye on the fibers, the improvement of adding a salt selected from the group consisting of ammonium and metal salts to said liquor, wherein the salt and amount thereof are selected to provided dyed said nylon fibers having a K/S value at least three times greater than if said salt were omitted from said liquor.

2. The improvement of claim 1 wherein said salt is ammonium sulfate.

3. The improvement of claim 1 wherein said carpet is passed through an aqueous solution of wetting agent prior to being passed through said zone.

4. The improvement of claim 3 wherein said salt is added to said liquor by means of a coating thereof applied to said fibers from said aqueous solution of wetting agent.

5. The improvement of claim 1 wherein said salt is added directly to said liquor.

6. The improvement of claim 1 wherein said salt is added to said liquor in an amount ranging from 0.2% to 8%, based on the weight of fiber.

7. The improvement of claim 1 wherein said liquor is at ambient temperatures and at a pH in the range of 4.5 to 7.5.

8. The improvement of claim 1 wherein said carpet is exposed to said atmosphere of steam for a period of less than five minutes.

9. The improvement of claim 1 wherein said salt and amount thereof is selected to provide dyed said nylon fibers having a K/S value of at least about 20.

10. The improvement of claim 9 wherein said salt is ammonium sulfate.

* * * * *